US011641922B2

(12) United States Patent
Saito

(10) Patent No.: US 11,641,922 B2
(45) Date of Patent: May 9, 2023

(54) HAIR APPLICATOR

(71) Applicant: MITSUBISHI PENCIL COMPANY, LIMITED, Tokyo (JP)

(72) Inventor: Shoichi Saito, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 471 days.

(21) Appl. No.: 16/758,441

(22) PCT Filed: Oct. 24, 2018

(86) PCT No.: PCT/JP2018/039566

§ 371 (c)(1),
(2) Date: Apr. 23, 2020

(87) PCT Pub. No.: WO2019/082944

PCT Pub. Date: May 2, 2019

(65) Prior Publication Data

US 2020/0260830 A1 Aug. 20, 2020

(30) Foreign Application Priority Data

Oct. 25, 2017 (JP) ..... JP2017-206103

(51) Int. Cl.
*A45D 19/00* (2006.01)
*A45D 34/04* (2006.01)
(Continued)

(52) U.S. Cl.
CPC ..... *A45D 34/042* (2013.01); *A45D 19/026* (2021.01); *A45D 24/22* (2013.01); *A45D 24/26* (2013.01); *A45D 2200/1009* (2013.01)

(58) Field of Classification Search
CPC .... A45D 34/042; A45D 19/026; A45D 24/22; A45D 24/26; A45D 2200/1009; A45D 24/24
(Continued)

(56) References Cited

U.S. PATENT DOCUMENTS 4,376,441 A * 3/1983 Duncan ..... A45D 24/22 401/289
5,325,878 A 7/1994 McKay
(Continued)

FOREIGN PATENT DOCUMENTS

JP 073430/1973 3/1975
JP H05-104894 A 4/1993
(Continued)

OTHER PUBLICATIONS

English translation of the Japanese Patent No. 2016077686 A (Sep. 15, 2022).*

*Primary Examiner* — Eisa B Elhilo
(74) *Attorney, Agent, or Firm* — Renner, Otto, Boisselle & Sklar, LLP

(57) ABSTRACT

To provide a hair applicator which can fix an applying part to combing elements with a sufficient fixing strength to prevent the applying part from being displaced even by an impact from a fall and also can dispense a sufficient coating amount. The hair applicator is configured such that the coating amount by the applying part is 0.090 g/m or greater (porosity is 80% or higher) and the hardness (ISO7619A) of the applying part is less than A70.

6 Claims, 14 Drawing Sheets

(51) Int. Cl.
*A45D 24/22* (2006.01)
*A45D 19/02* (2006.01)
*A45D 24/26* (2006.01)

(58) Field of Classification Search
USPC ..... 401/266
See application file for complete search history.

(56) References Cited

U.S. PATENT DOCUMENTS

| | | | | |
|---|---|---|---|---|
| 5,813,785 | A * | 9/1998 | Baudin | B65D 83/285 401/266 |
| 2001/0042553 | A1 | 11/2001 | Duqueroie | |
| 2008/0060665 | A1* | 3/2008 | Umeno | A45D 24/24 401/196 |
| 2008/0083415 | A1* | 4/2008 | Umeno | A45D 34/042 132/116 |
| 2008/0149133 | A1 | 6/2008 | Fleischer et al. | |

FOREIGN PATENT DOCUMENTS

| | | | |
|---|---|---|---|
| JP | H07-223396 | A | 8/1995 |
| JP | H11-169224 | A | 6/1999 |
| JP | 2002-28557 | A | 1/2002 |
| JP | 2007-260137 | A | 10/2007 |
| JP | 2016-77686 | A | 5/2016 |
| JP | 2016-87068 | A | 5/2016 |
| JP | 2017-104482 | A | 6/2017 |
| WO | 2006006378 | A1 | 1/2006 |

* cited by examiner (a)

(b)

HAIR APPLICATOR

TECHNICAL FIELD

The present invention relates to a hair applicator for applying a hair cosmetic such as a hair dye, which is attached to a container body to apply an application liquid (hair dye, hair styling agent, hair restorer, etc.) stored in the container, to hair (hair including humans and other pet animals) while combing the hair.

BACKGROUND ART

Conventionally, there has been known hair applicators for dyeing hair by leading a hair dye or the like contained in a container between the comb elements of a comb attached to the container and combing the hair with the comb.

As to such hair applicators, the following Patent Documents 1 to 4 disclose hair applicators which have a structure including a combing body joined with an applying part of a porous material such as a sponge to apply and infiltrate the application liquid to the hair while combing with the combing body.

However, Patent Documents 1 to 4 have the following problems.

First, in the hair applicator described in Patent Document 1, in order to fix an applying part, the applying part is pressed and fitted into a combing body. However, in this method, when a soft felt is used as the applying part, the applying part is easily displaced due to a dropped impact. On the other hand, use of a hard applying part can increase the fixing strength but lowers the porosity to narrow the fluid passage, so that it becomes impossible to secure a sufficient coating amount.

In the hair applicators of Patent Documents 2 and 3, the combing body is fixed by provision of a bridge to prevent the porous applying part from falling off. However, in this hair applicator, since the spacing between the comb elements is wide, the tips of the comb elements easily sink into the skin, so that the applying part easily touches and stains the skin. If a large clearance is secured between the combing body and the applying part in order to prevent the skin from being stained, there occurs a problem that the strength of contact of the applying part against the hair is weakened, so that the coating amount decreases.

Further, in the hair applicator disclosed in Patent Document 4, a non-infiltration member is integrally molded around the applying part (cosmetic penetrating member) to prevent the skin from being stained due to displacement of the applying part. However, the molding method is limited to extrusion molding, so that the manufacturing method and configuration lose flexibility. In addition, this method is easily expected to raise the costs required for, for example, the integral molding of the non-infiltration member and the grinding process after the integral molding.

PRIOR ART DOCUMENTS

Patent Document

[Patent Document 1]
Japanese Patent Application Laid-Open Hei 11 No. 169224
[Patent Document 2]
Japanese Patent Application Laid-Open No. 2016-087068
[Patent Document 3]
Japanese Patent Application Laid-Open No. 2017-104482

[Patent Document 4]
Japanese Patent Application Laid-Open No. 2007-260137

SUMMARY OF THE INVENTION

Problems to be Solved by the Invention

The present invention has been devised in view of the above circumstances, it is therefore an object of the present invention to provide a hair applicator which can fix an applying part to a comb with a sufficient fixing strength to prevent the applying part from being displaced even by an impact from a fall and also can dispense a sufficient coating amount.

Means for Solving the Problems

The present invention resides in a hair applicator comprising: an applying part made of a porous material; and a comb having a plurality of comb elements provided with the applying part, to thereby apply a hair dye from a container through the applying part to the hair while combing hair with the comb, and is characterized in that the coating amount by the applying part is 0.090 g/m or greater (porosity is 80% or higher) and the hardness (ISO7619A) of the applying part is less than A70.

Effect of the Invention

According to the hair applicator of the present invention, the applying part can be secured to the comb with a sufficient securing strength, so that it possible to prevent the applying part from being displaced even by an impact from a fall and obtain a sufficient coating amount.

MODES FOR CARRYING OUT THE INVENTION

Hereinafter, embodiments of the present invention will be described with reference to the accompanying drawings.

First Embodiment

FIGS. 1 to 6 are illustrative diagrams showing a hair applicator according to the first embodiment.

Figure 1:
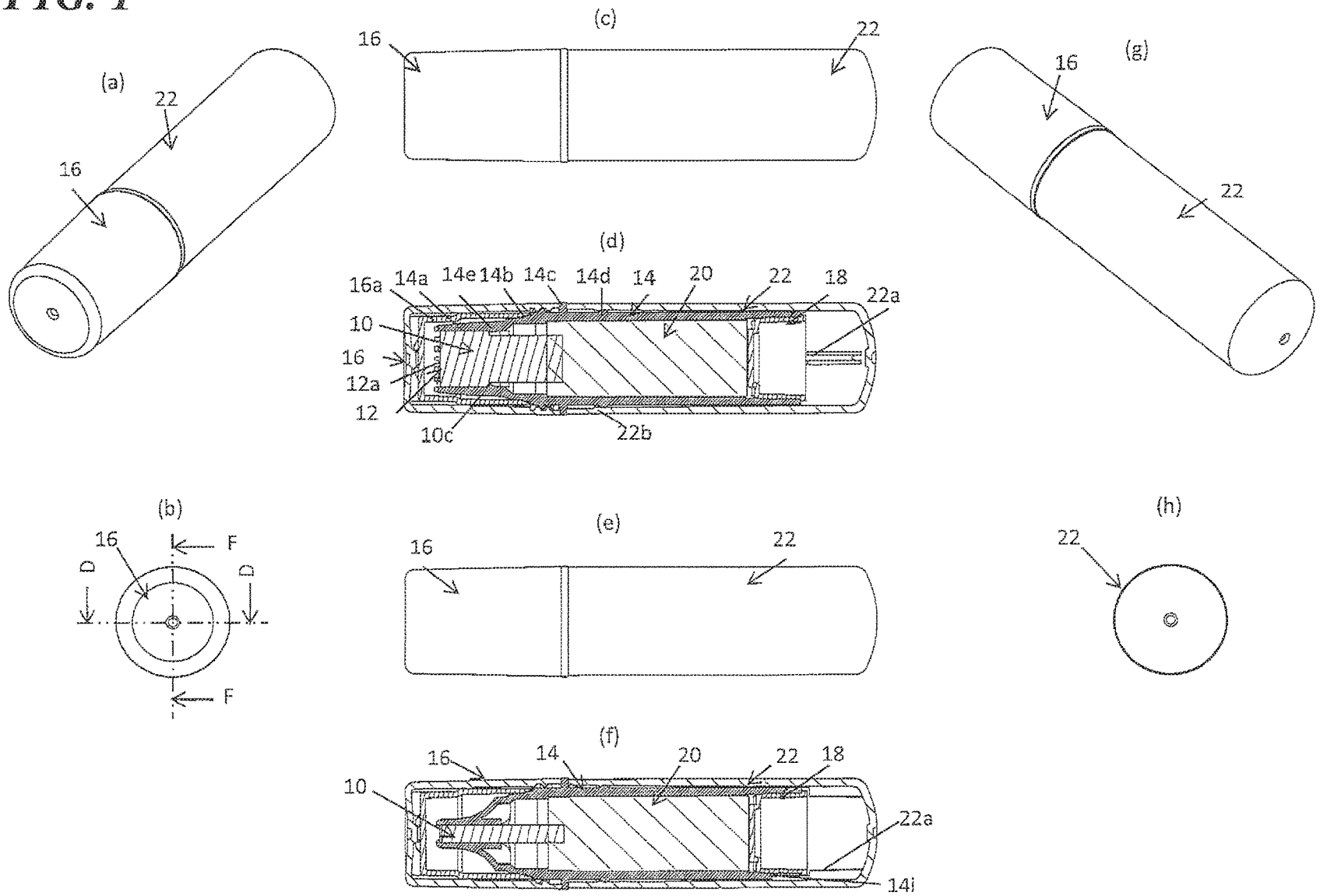
FIG. 1 Illustrative diagrams showing a hair applicator in its capped state, according to a first embodiment of the present invention, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, and (h) is a view from the rear side.
Figure 2:
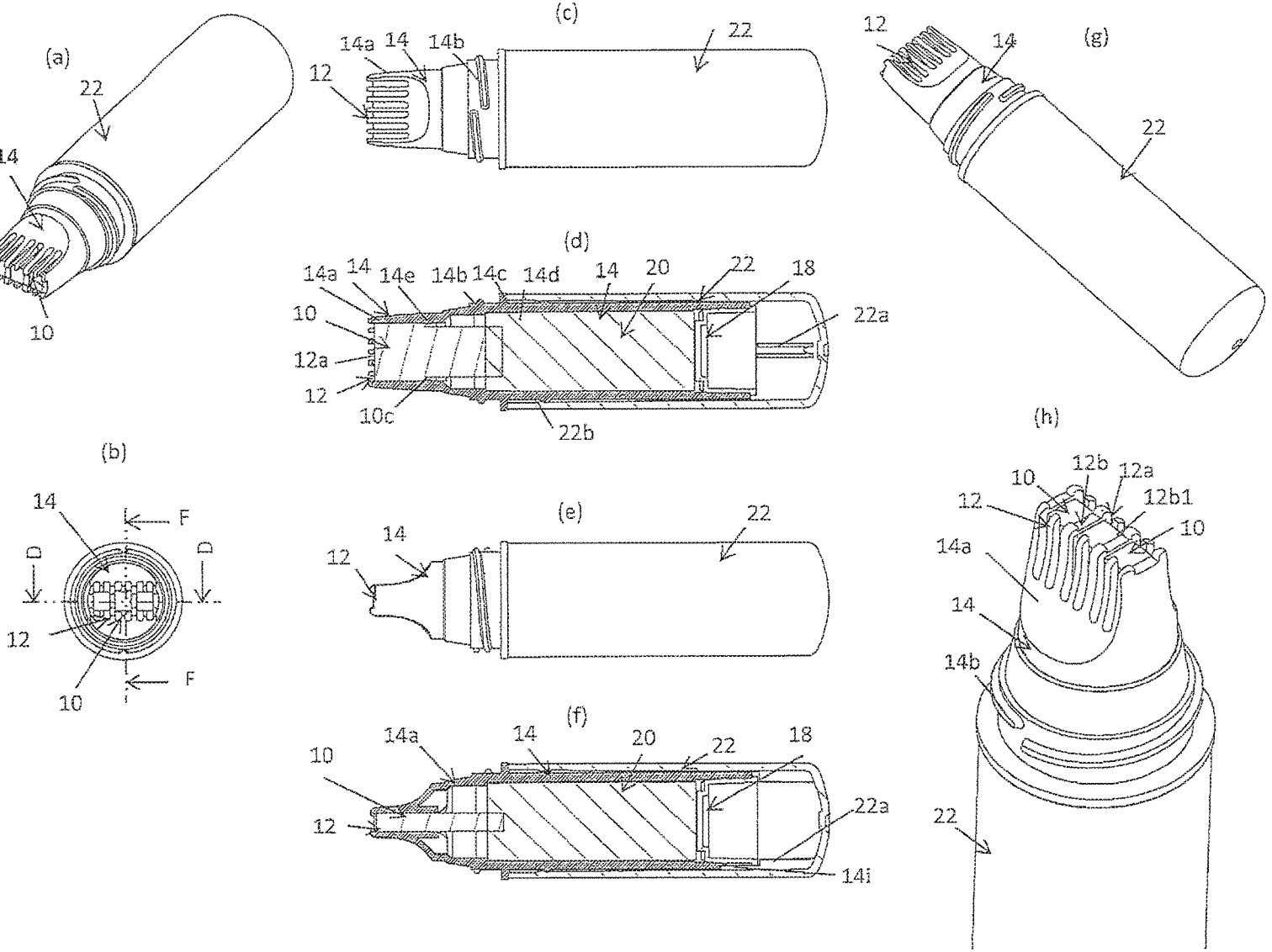
FIG. 2 Illustrative diagrams showing the hair applicator of FIG. 1 in its uncapped state, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, and (h) is an enlarged perspective view showing the front end part.
Figure 3:
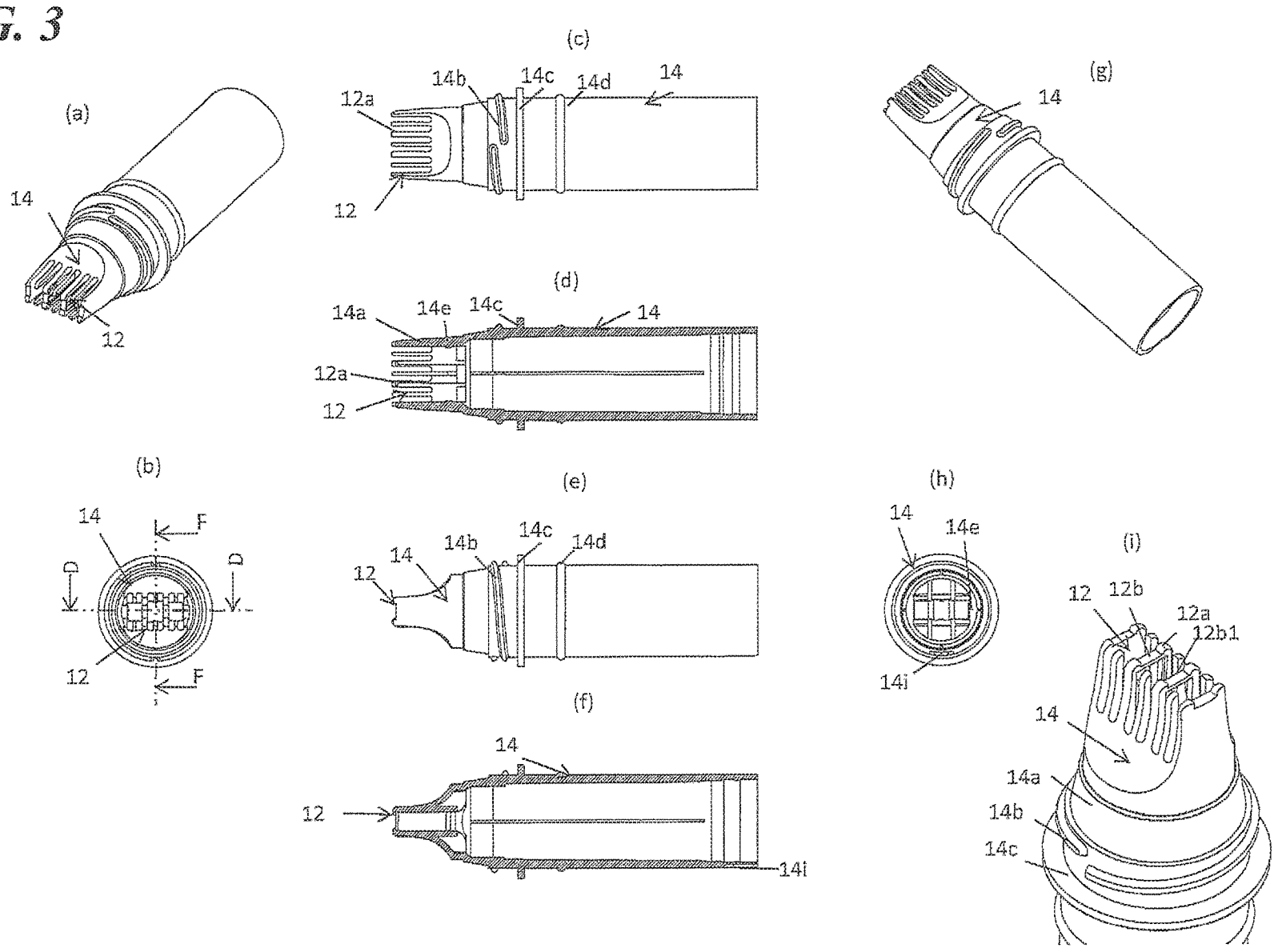
FIG. 3 Part drawings showing the front barrel of the hair applicator of FIG. 1 in its uncapped state, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, (h) is a view from the rear side, and (i) is an enlarged perspective view showing the front end part.

As shown in FIGS. 1 to 3, the hair applicator according to the embodiment includes an applying part 10 of a porous material and a comb 12 having comb elements 12*a*, formed with the applying part 10. The hair applicator is an applicator for hair that can dispense a hair dye in the front barrel (corresponding to the "container") 14 from the applying part 10 to the hair when the comb 12 combs the hair.

Detailedly, as shown in FIG. 1, the hair applicator has a cap 16 detachably attached to a front end part 14*a* of the front barrel 14 so as to cover the applying part 10. The cap 16 prevents the applying part 10 from drying by putting an inner cap 16*a* in hermetic contact with the outer peripheral side of the front end part 14*a* of the front barrel 14.

[Front Barrel 14]

As shown in FIG. 2, the front barrel 14 has a substantially hollow cylindrical shape with the front end part 14*a* formed in a spatulate flat appearance having an opening forward of the hollow. The comb 12 is formed in the front end part 14*a* so as to surround the opening, and the applying part 10 is exposed from the opening. A tail plug (lid) 18 is fitted to the rear end of the front barrel 14 to close the hollow inside the front barrel 14 so as to provide a container function. In addition, an absorbent fabric 20 is stuffed in the closed space in the front barrel 14, and impregnated with the hair dye.

The applying part 10 is arranged inside the comb 12 of the front barrel 14. The rear end of applying part 10 is inserted into the front portion of the absorbent fabric 20, so that the hair dye of the absorbent fabric 20 permeates the applying part 10.

As shown in FIGS. 1 and 2, the front barrel 14 is covered from the center to the rear with a rear barrel 22. The rear barrel 22 has a cylindrical shape with a closed rear end, and a rib 22*a* for preventing rotation of the front barrel 14 is formed on the inner periphery along the axial direction. The rib 22*a* is formed as a projected portion such as a parallel rail. The front barrel 14 has a recess 14*i* formed along the axial direction on the outer surface in the rear portion thereof (see FIG. 3).

The recess 14*i* of the front barrel 14 mates with the locking rib 22*a* to prevent the front barrel 14 from rotating with respect to the rear barrel 22.

As shown in FIGS. 1 and 2, the front barrel 14 has a male thread 14*b* on the outer peripheral side of the front end part 14*a* for the cap 16 to be screwed thereon. In addition, a flange 14*c* is formed on the outer periphery adjacent to the rear of the male screw 14*b*. Further, a fitting rib 14*d* is formed behind the flange 14*c* on the outer periphery.

The rear barrel 22 has an annular projected portion 22*b* on the inner surface in the front part thereof.

When the rear part of the front barrel 14 is pushed rearward into the front opening of the rear barrel 22 until the flange 14*c* abuts the rear barrel 22, the projected portion 22*b* inside the rear barrel 22 is engaged with the rib 14*d* so that the rear barrel 22 will not come off (fall out) from the front barrel 14.

In addition, projected portions 14*e* are formed inside the front end part 14*a* of the front barrel 14 to catch a step portion 10*c* of the applying part.

[Applying Part 10]

The applying part 10 is formed of a porous material, which dispenses a coating amount of 0.090 g/m or greater (porosity of 80% or higher) and has a hardness (ISO7619A) of less than A70.

Figure 4:
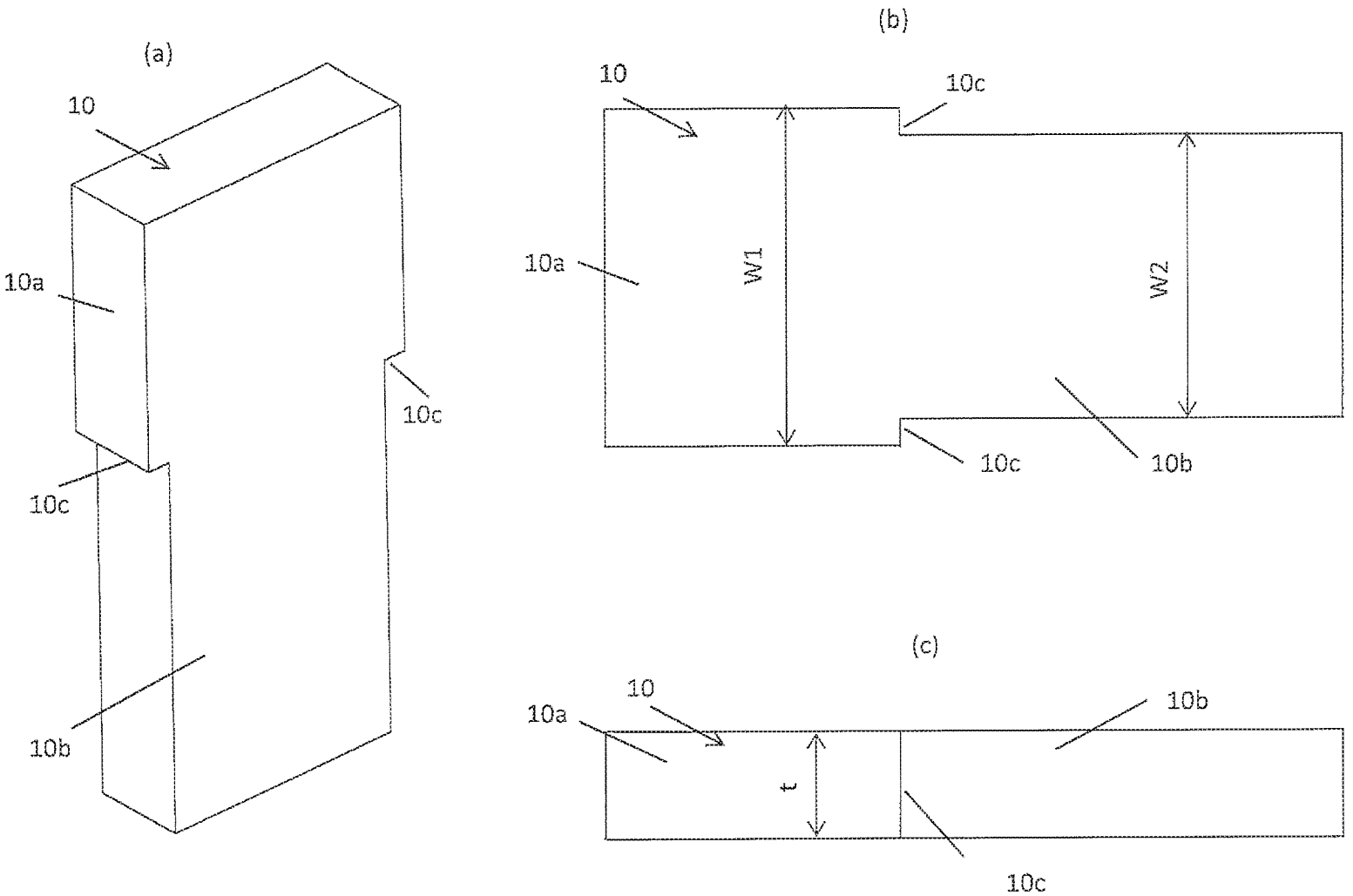
FIG. 4 Part drawings showing an applying part of the hair applicator of FIG. 1, (a) is a side perspective view, (b) is a view from one side (wide side), and (c) is a view from the other side (narrow side).

Specifically, as shown in FIG. 4, the applying part 10 is given in the form of a flat plate having a greater width relative to the thickness. The applying part 10 is formed of a front portion (applying tip side) 10*a* of a width W1 and a rear portion 10*b* of a width W2 smaller than W1, forming a substantially T-shape.

The applying part 10 uses felt as the porous material in the embodiment. The dimensions of the applying part 10 are such that the thickness t is about 7 to 2 (mm), the width W1 of the front portion 10*a* is wider than the width W2 of the rear part 10*b* (W1>W2), and a step 10*c* is formed at the boundary between the front portion 10*a* and the rear portion 10*b*. The width W1 can be 15 to 10 (mm) and the width W2 can be 13 to 8 (mm). Further, the length of the front portion 10*a* can be 15 to 10 (mm) and the length of the rear portion 10*b* can be 13 to 8 (mm). The rear endface of the rear portion 10*b* contacts the absorbent fabric 20, but can be made flat.

As shown in FIG. 1, in the state where the applying part 10 is attached to the front barrel 14, the front portion 10*a* of the width W1 serving as the applying tip is fitted inside of the front end part 14*a*. Further, the step 10*c* located at the boundary to the rear portion 10*b* of the width W2 is locked by the projected portions 14*e* formed in the front end part 14*a* of the front barrel 14. Therefore, this locking prevents the applying part 10 from sliding backward into the absorbent fabric 20 in the front barrel 14.

[Comb 12]

Figure 5:
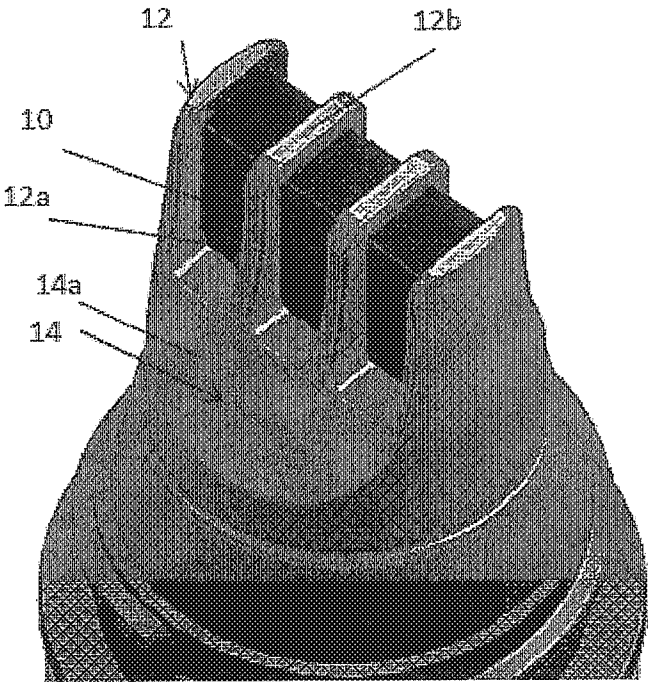
FIG. 5 (a) is an enlarged perspective view of the vicinity of a comb in a front barrel of a comparative example, and (b) is an enlarged perspective view of the vicinity of a comb in a front barrel of a variational example 1.
Figure 5:
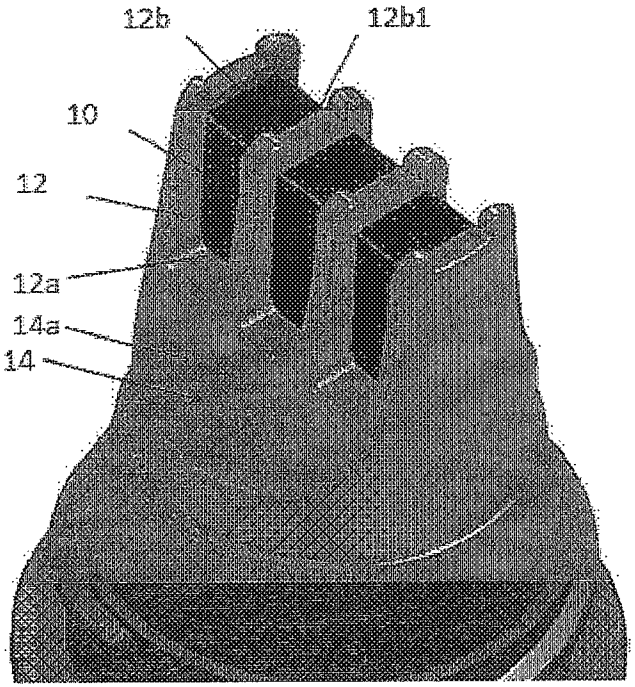

In the comb 12, as shown in FIGS. 2 and 5, a plurality of comb elements 12*a* extending forward are formed integrally with the front end part 14*a* of the front barrel 14.

The front end part 14*a* has a rectangular opening, and holds the applying part 10 therein. The front end part 14*a* is configured such that the applying part 10 is held by the comb 12 on the front side with the tips of the comb elements 12*a* project forward beyond the front end of the applying part 10.

In the comb 12, as shown in FIGS. 2 and 5, beams 12*b* for anti-falling (preventing the applying part 10 from falling forward) are formed so as to connect the opposing comb elements 12*a*. In addition, the step 10*c* abuts against the projected portions 14*e* inside the front barrel 14 (the front end part 14*a*) in the interior of the comb 12 to prevent the applying part 10 from moving rearward.

Therefore, even if the applying part 10 is made of a felt or the like that is softer than the applying part that is press-fitted in the conventional front barrel (Patent Document 1 and Patent Document 4), the applying part 10 is positioned and fixed on the front side by the beams 12*b*, and on the rear side by the projected portions 14*e*, so that the applying part 10 will not be displaced.

As described later, in the first embodiment, as shown in FIGS. 2 and 5(*b*), the beam 12*b* between the comb elements 12*a* has a hollow 12*b*1 formed on the surface thereof. Further, the surface area of the tip of the comb element 12*a* is specified to be 0.3 to 1.0 $mm^2$.

As to the applying part 10, the higher the porosity, the greater the coating amount. When the coating amount is 0.090 g/m or greater (porosity of 80% or higher) while the hardness (ISO7619A) of the applying part 10 is less than A70, the hardness is sufficient, so that it is possible to prevent the applying part from coming off from the front end part 14*a* of the front barrel 14.

Therefore, according to the hair applicator according to the first embodiment, the applying part can be fixed to the comb elements with a sufficient fixing force, and prevented from being displaced even by an impact from a fall while an ample coating amount can be secured.

Yet, since the hardness of the applying part 10 may degrade when the porosity is increased, the beams 12*b* are provided between the comb elements 12*a* of the front end part 14*a*, as described above. As shown in detail in FIGS. 2 and 5, the beams 12*b* provide a stopper function for the applying part 10.

(Hair Bundle Application Test)

With the hair applicator according to the embodiment, an evaluation test was performed on the applying part 10 that was specified so that the coating amount was 0.090 g/m or greater (porosity is 80% or higher) and the hardness (ISO7619A) of the applying part 10 was less than A70.

The felt cores for the evaluated applying parts are as shown in Table 1 below.

TABLE 1

| Felt Core | Porosity | Hardness | Applied Amount |
|---|---|---|---|
| Example 1 | 90% | A40 | 0.115 g |
| Example 2 | 81% | A60 | 0.104 g |
| Comp. Example 1 | 73% | A80 | 0.079 g |
| Comp. Example 2 | 68% | A55 | 0.069 g |

In Table 1, the applying parts of Examples 1 and 2 of the present invention were felt cores, and the coating amount was 0.115 (g) in Example 1 and 0.104 (g) in Example 2.

The applying parts of Comparative Examples 1 and 2 were felt cores, and the coating amount was 0.079 (g) in Comparative Example 1 and 0.069 (g) in Comparative Example 2.

The porosity of each of Examples 1 and 2 and Comparative Examples 1 and 2 is an actual measurement value, which was obtained as the volume converted from the full filling weight of ethanol.

The hardness is also an actual measurement value, which was obtained by using a rubber hardness meter (conforming to ISO7619A).

The investigation of the amount of liquid applied in Examples 1 and 2 and Comparative Examples 1 and 2 was based on the measurement of the applied material by the following hair bundle application test.

The object to be coated:

goat hair bundle (10 cm·1 g)×2 bundles

Application speed: 10 cm/sec (second)

Preparation for application test: put a sponge in zipper bag on wall.

Application test procedures:

(1) Set two hair bundles on the sponge;

(2) "Apply 10 cm->1 sec break"×10 strokes->measure the liquid consumption;

(3) Turn over the hair bundles;

(4) "Apply 10 cm->1 sec break"×10 strokes->measure the liquid consumption; and (5) Prepare new hair bundles and return to (1).

The results obtained by repeating (1) to (5) ten times are shown in Table 1.

As shown in Table 1, each coating amount was 0.115 (g) in Example 1 and 0.104 (g) in Example 2, whereas the coating amount was 0.079 (g) in Comparative Example 1, and coating amount of Comparative Example 2 was 0.069 (g). The applicators of Examples 1 and 2 have a coating amount of 10 to 12 times or more that of the applicators of Comparative Examples 1 and 2. Thus, according to the present invention, it has become clear that a markedly sufficient amount of coating (approximately an order of magnitude greater) can be applied to the hair.

Next, measures against skin stains in the hair applicator of the first embodiment will be described.

In FIG. 5, (a) shows a comparative example, and (b) shows a variational example 1.

Because the comb 12 of the front barrel 14 has its front end located ahead of the applying part, if the front end of the comb 12 is formed flat as in the comparative example shown in FIG. 5(*a*), the fluid may adhere to the skin.

More specifically, the cosmetic (application liquid) applied to the hair transfers to the flat top surface of the comb 12 and the top surface touches the skin so that the hair cosmetic is transferred to adhere to and stain the skin.

To deal with this, in the variational example 1 shown in FIG. 5B, the hollow 12*b*1 is formed on the front endface of the beam 12*b* of the comb 12 to reduce the contact area between the skin and the comb 12, so that transfer of the liquid can be avoided.

Another countermeasure against staining will be described with reference to FIG. 6.

Figure 6:
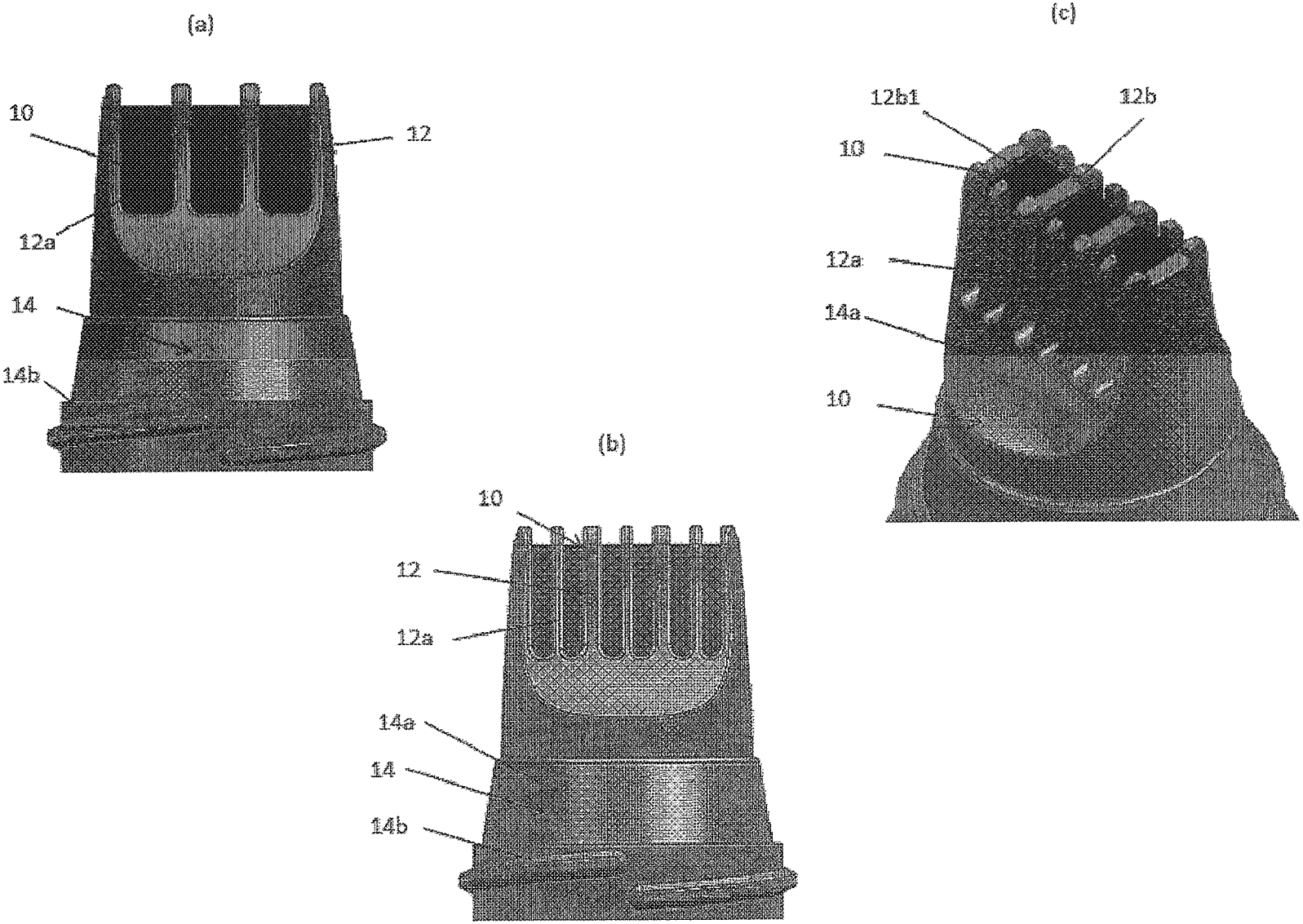
FIG. 6 (a) is an enlarged perspective view of the vicinity of a comb in a front barrel of a comparative example, (b) is an enlarged side view of the vicinity of a comb in a front barrel of the first embodiment, and (c) is an enlarged perspective view of the vicinity of a comb in a front barrel of the first embodiment.
Figure 7:
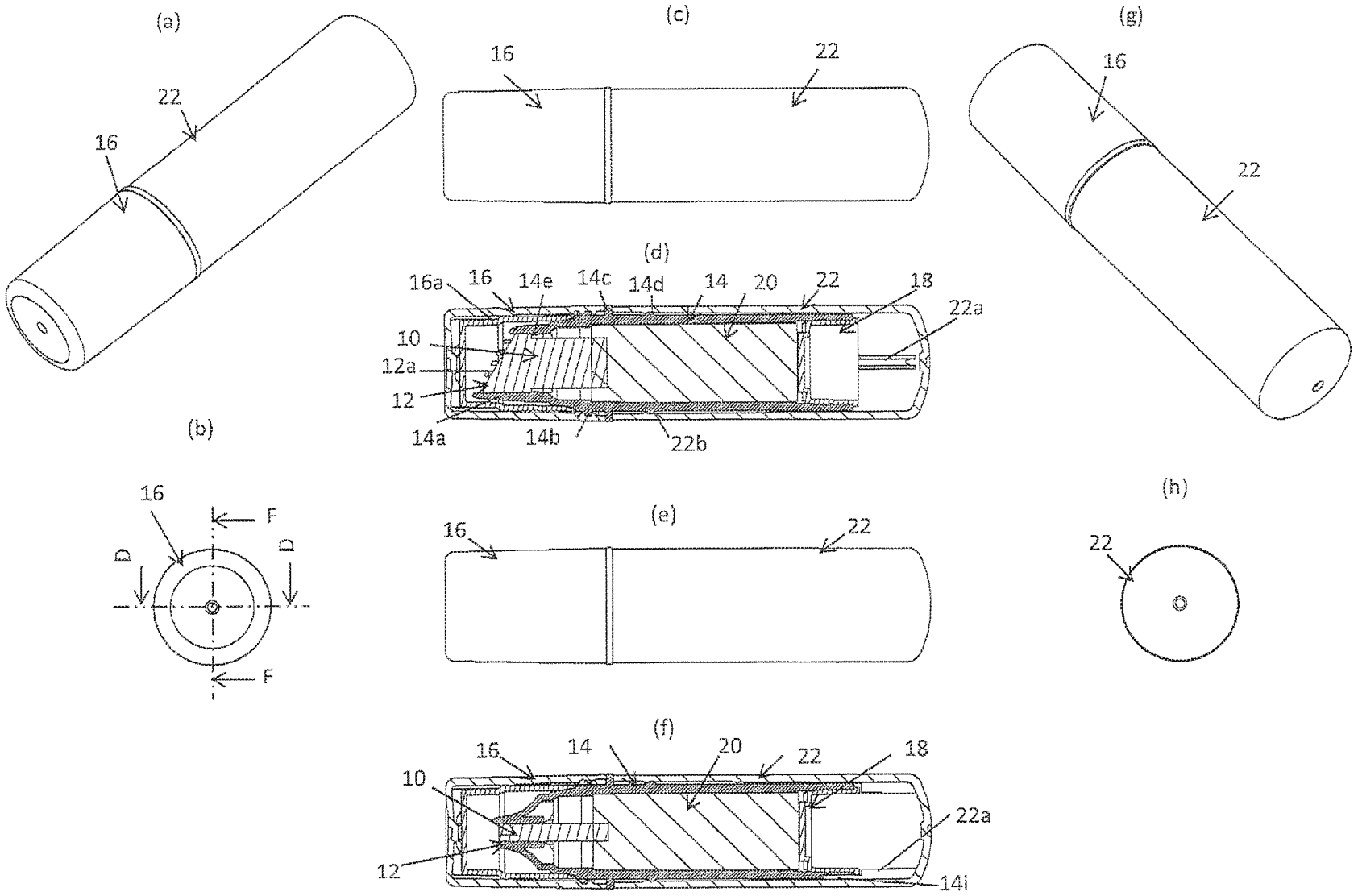
FIG. 7 Illustrative diagrams showing a hair applicator in its capped state, according to a second embodiment of the present invention, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, and (h) is a view from the rear side.
Figure 8:
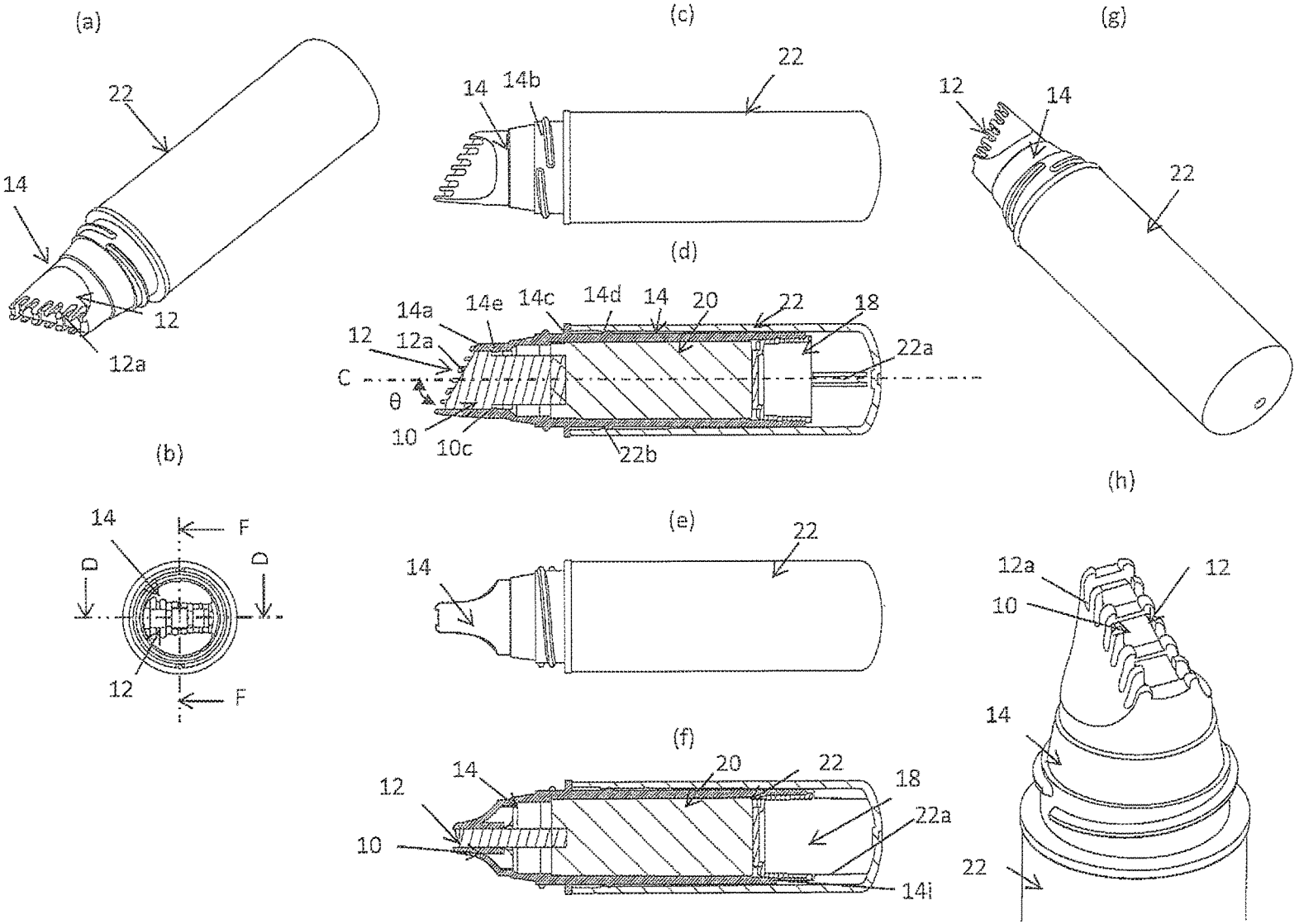
FIG. 8 Illustrative diagrams showing the hair applicator of FIG. 7 in its uncapped state, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, and (h) is an enlarged perspective view showing the front end part.
Figure 9:
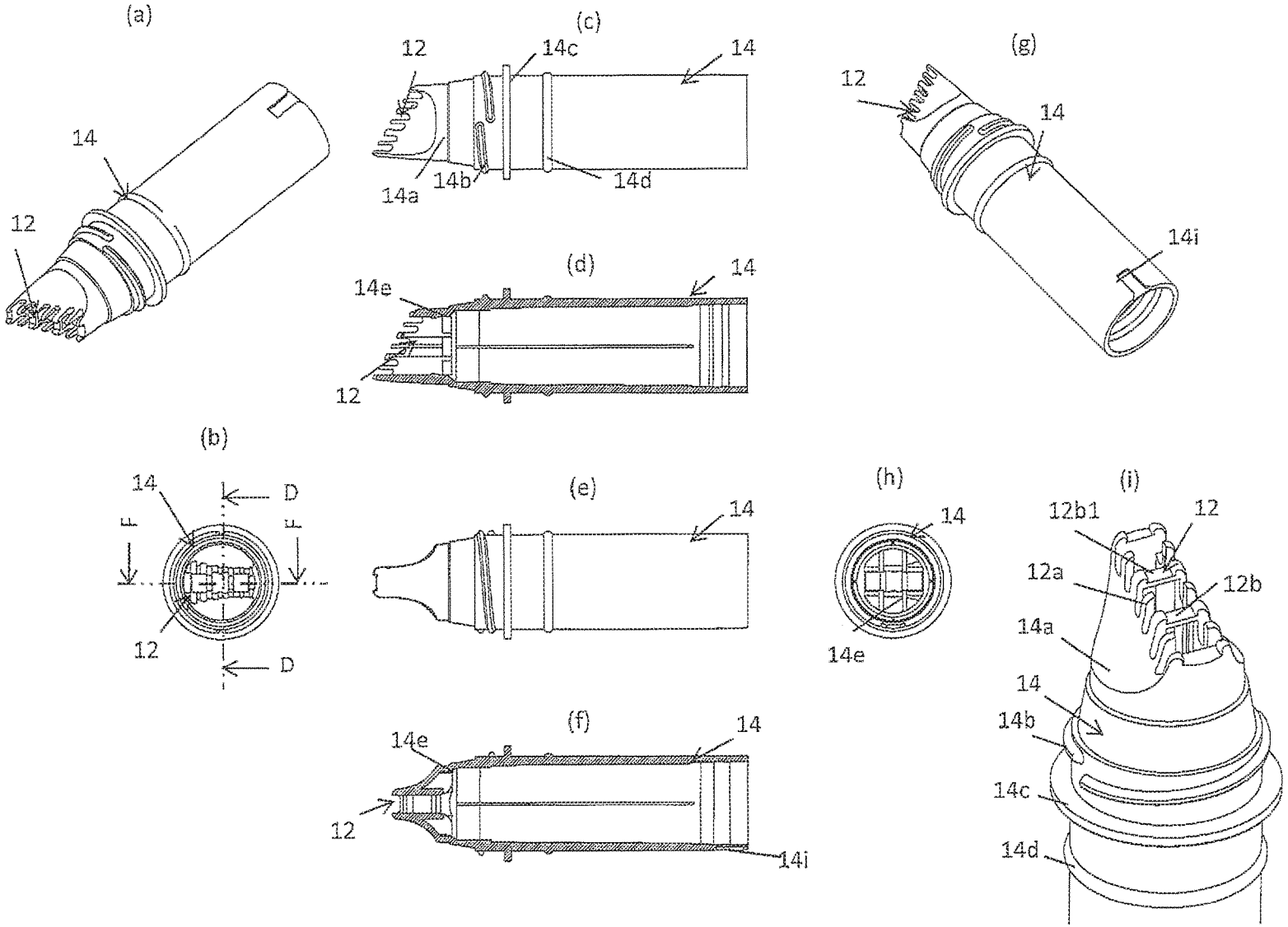
FIG. 9 Part drawings showing the front barrel of the hair applicator of FIG. 7 in its uncapped state, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, (h) is a view from the rear side, and (i) is an enlarged perspective view showing the front end part.

In FIG. 6, (a) shows a comparative example, and (b) and (c) show the front barrel of the first embodiment.

In the hair applicator according to the first embodiment, the cosmetic is more likely to adhere to the skin than in the conventional product. That is, as the comb elements 12*a* of the comb 12 are reduced in number, the contact area is reduced, hence it became easier to sink into the skin, and the applying part 10 easily comes into direct contact with the skin.

To deal with this, though the comb 12 in the comparative example shown in FIG. 6A has two pairs of comb elements 12*a*, the comb 12 of the first embodiment shown in FIGS. 6B and 6C has five pairs of comb elements 12*a* so as to suppress sinking into the skin and make staining the skin unlikely.

In addition, as shown in detail in FIG. 6C, in the first embodiment, the beam 12*b* is provided in every other pair of the comb elements 12*a* among the five pairs in the comb 12, and hollows 12*b*1 are also formed. Specifically, in the first embodiment, the area of the flat part in the front end of the comb part 12 was 0.4 $mm^2$, and the gap between the comb elements 12*a* was 1.3 mm.

The step height of the hollow 12*b*1 in the preferred comb 12 was found to be 0.5 to 0.9 mm.

Second Embodiment

Next, a hair applicator according to a second embodiment will be described.

Figure 10:
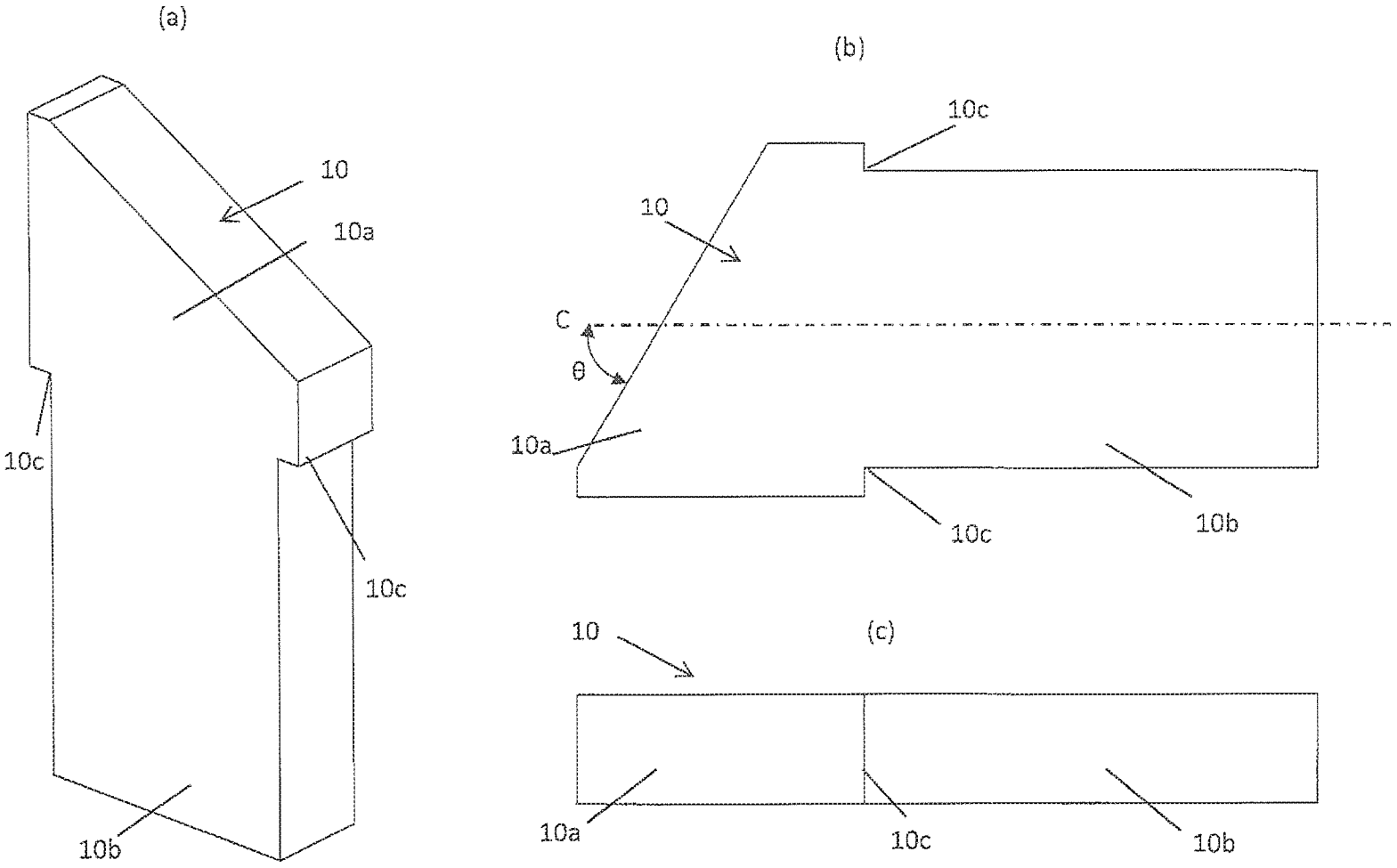
FIG. 10 Part drawings showing an applying part of the hair applicator of FIG. 7, (a) is a side perspective view, (b) is a view from one side (wide side), and (c) is a view from the other side (narrow side).

FIGS. 7 to 10 are illustrative diagrams of a hair applicator according to a second embodiment, and FIG. 10 is an illustrative view of an applying part. The hair applicator according to the first embodiment is configured such that the comb elements 12*a* of the comb 12 are arranged and formed in the direction perpendicular to the center axis of the front barrel 14. On the other hand, in the hair applicator according to the second embodiment, the comb elements 12*a* of the comb 12 are arranged and formed in an inclined manner at an angle θ with respect to the center axis of the front barrel 14 (indicated by the symbol "C" in FIG. 8).

Corresponding to the formation and arrangement of the comb elements 12*a* with respect to the center axis of the front barrel 14, the applying part 10 is slanted forming a front part 10*a* of the facet inclined at the angle θ with respect to the center axis (indicated by the symbol "C" in FIG. 10)

As to the other parts, the same components as those in the first embodiment are allotted with the same reference numerals.

According to the second embodiment, since the arrangement of the comb elements 12*a* of the comb 12 is slanted, the applicator can be obliquely applied to the hair unlike the first embodiment in which the applicator is applied vertically. It is hence suitable for application to the hairline and the like. Others are the same as in the first embodiment.

Third Embodiment

Next, a hair applicator according to a third embodiment will be described.

Figure 11:
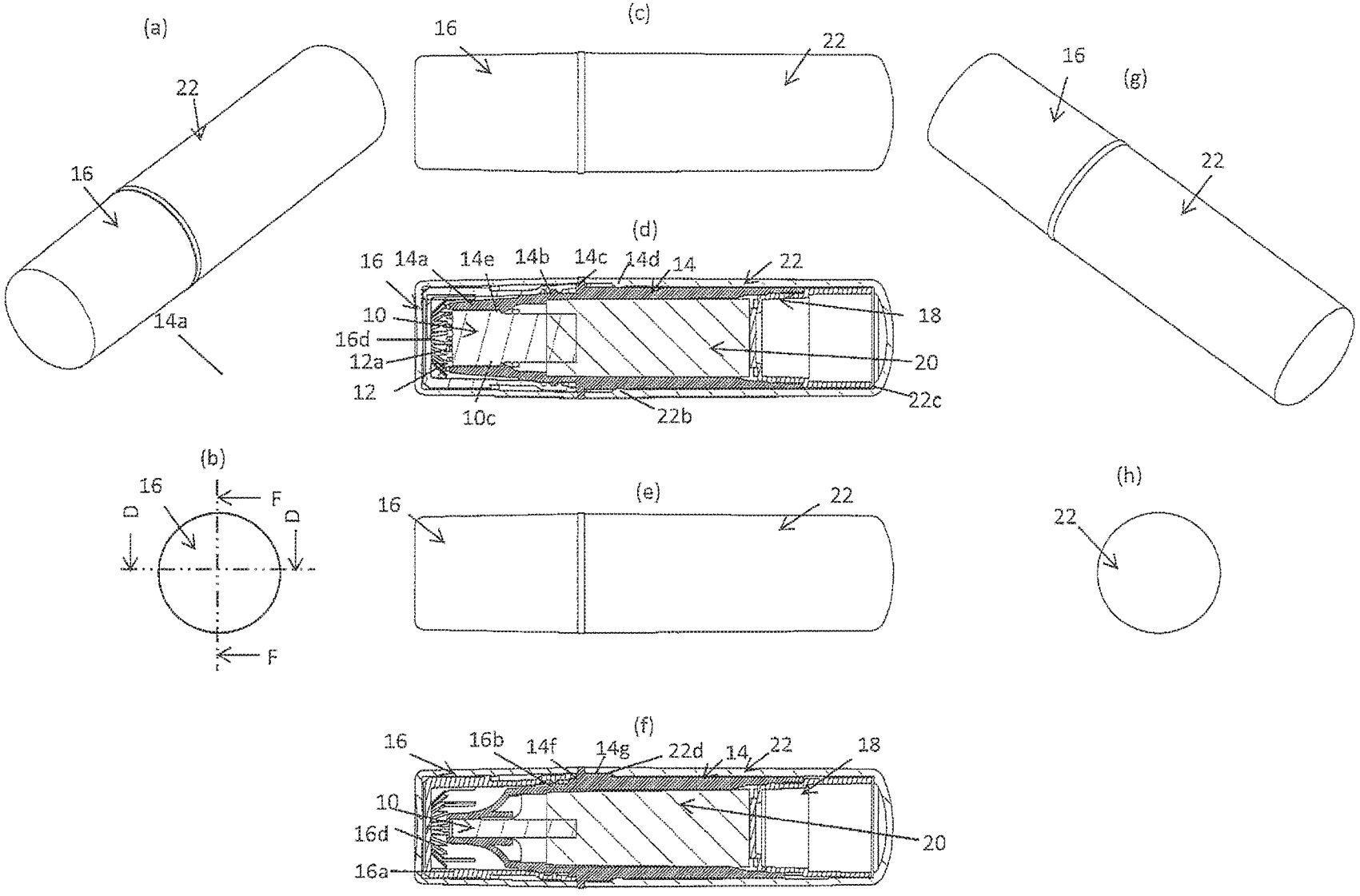
FIG. 11 Illustrative diagrams showing a hair applicator in its capped state, according to a third embodiment of the present invention, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, and (h) is a view from the rear side.
Figure 12:
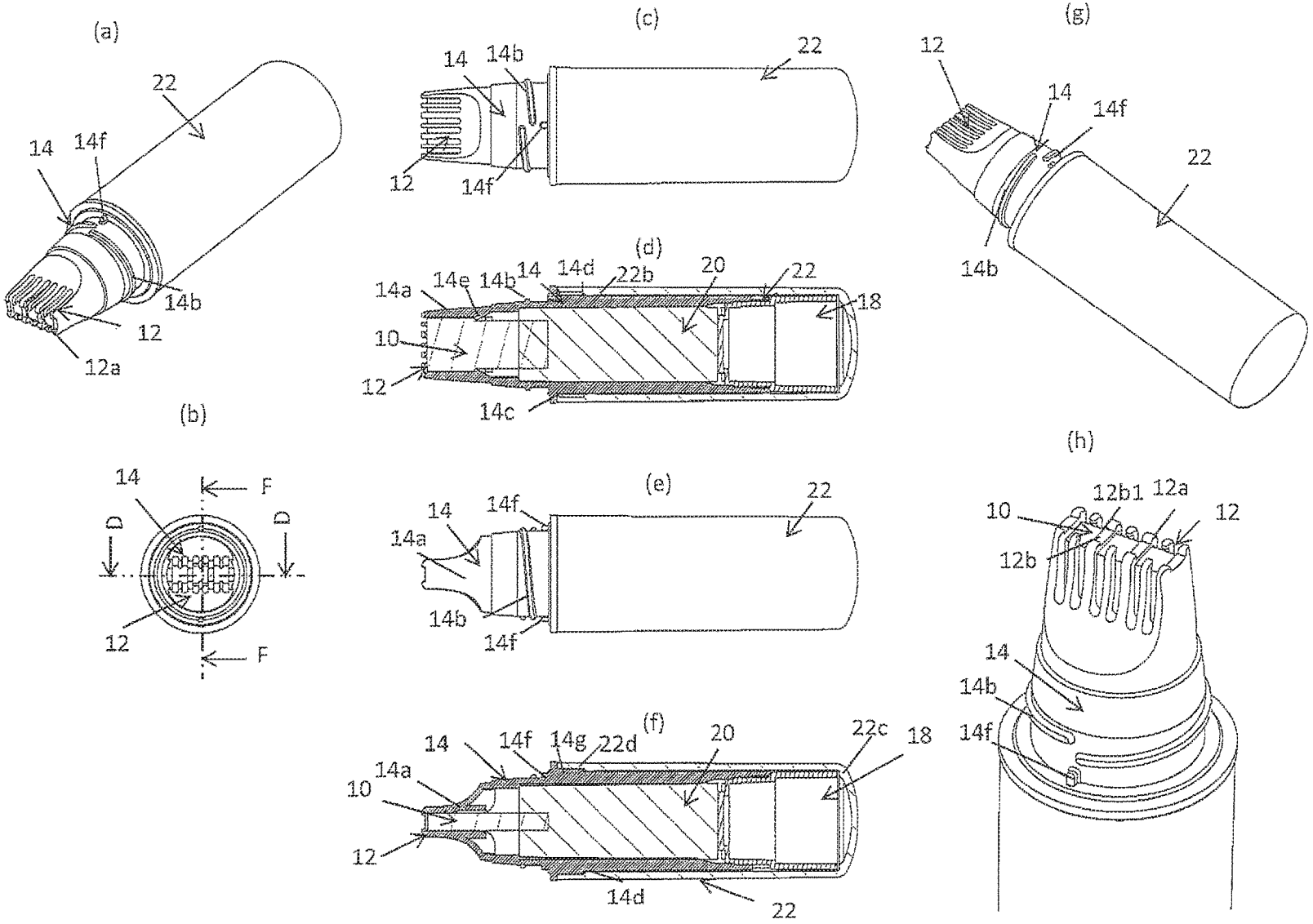
FIG. 12 Illustrative diagrams showing the hair applicator of FIG. 11 in its uncapped state, (a) is a perspective view from the front side, (b) is a view from the front side, (c) is a view from one side, (d) is a longitudinal section cut along a line D-D in (b), (e) is a view from the other side, (f) is a longitudinal section cut along a line F-F in (b), (g) is a perspective view from the rear side, and (h) is an enlarged perspective view showing the front end part.
Figure 13:
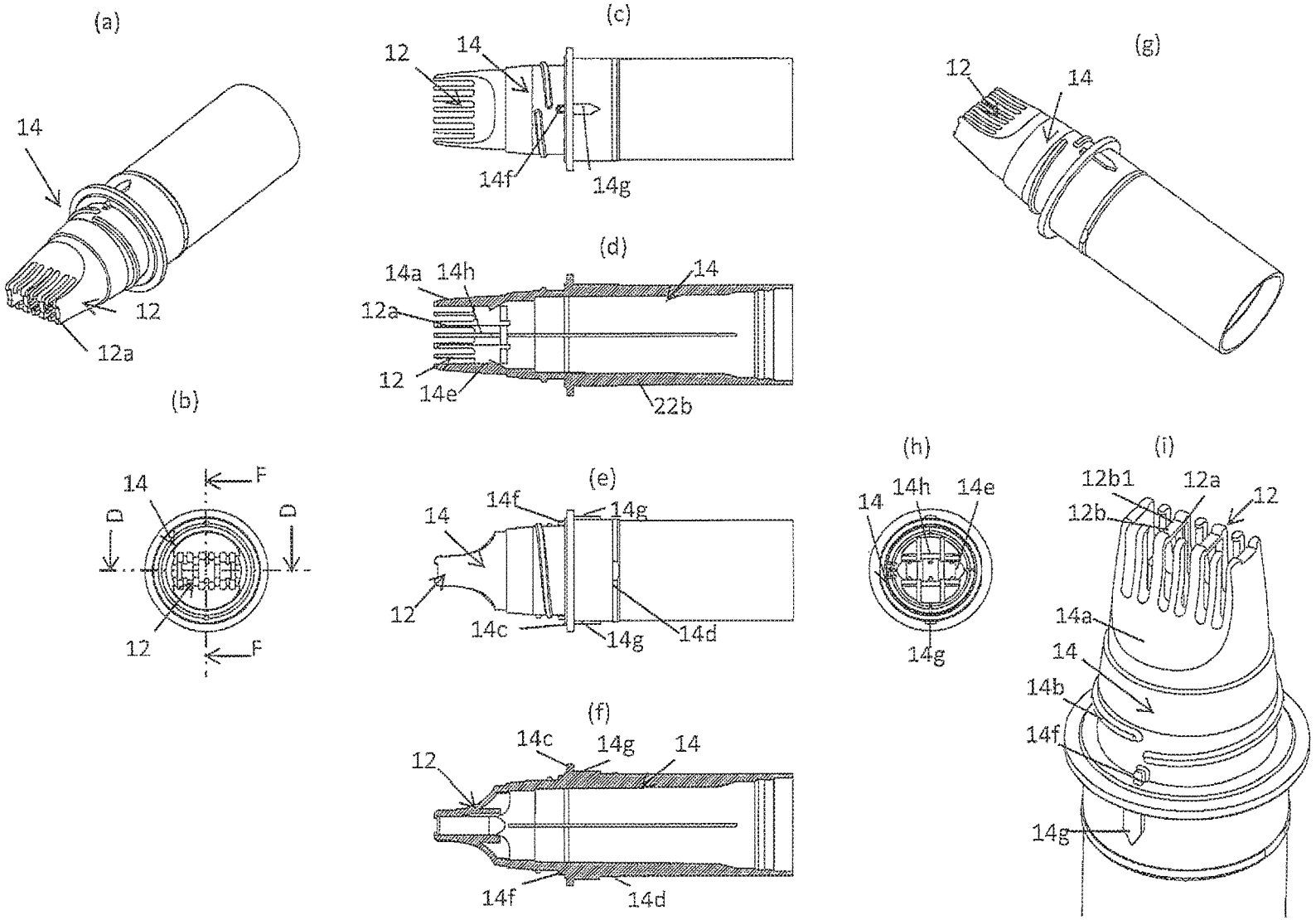
FIG. 13 Part drawings showing the front barrel of the hair applicator of FIG. 11 in its uncapped state, (a) is a perspective view from the front side, (b) is a view from the front side, (c) is a view from one side, (d) is a longitudinal section cut along a line D-D in (b), (e) is view from the other side, (f) is a longitudinal section cut along a line F-F in (b), (g) is a perspective view from the rear side, (h) is a view from the rear side, and (i) is an enlarged perspective view showing the front end part.
Figure 14:
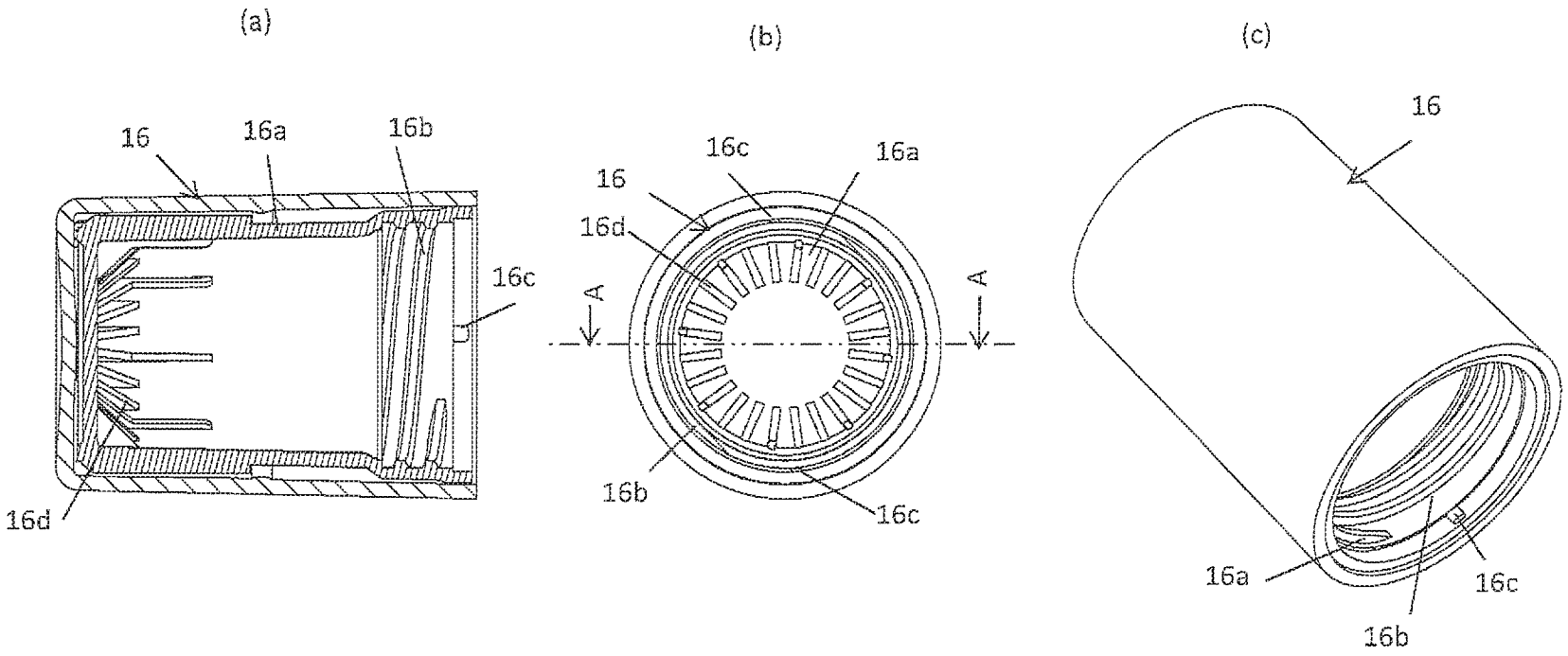
FIG. 14 Part drawings showing the cap in the hair applicator of FIG. 11, (a) is a longitudinal section cut along a line A-A in (b), (b) is a view from the rear side, and (c) is a perspective view from the rear side.

FIGS. 11 and 12 are illustrative diagrams of the hair applicator according to the third embodiment. FIG. 13 is an illustrative diagram of a front barrel, and FIG. 14 is an illustrative diagram of an applying part. The same parts as those in the first embodiment shown in FIGS. 1 to 4 are denoted by the same reference numerals. In the third embodiment, the applying part 10 and the absorbent fabric 20 are the same as those in the first embodiment, and those in the second embodiment can also be adopted. The third embodiment is different from the first and second embodiments in the configurations other than the applying part 10 and the absorbent fabric 20.

As shown in FIGS. 11 and 12, in the hair applicator of the third embodiment, a container for accommodating the absorbent fabric 20 is formed with the rear end of the front barrel 14 closed by a tail plug 18. The tail plug 18 abuts the inner surface 22*c* (bottom surface) at the rear end of the rear barrel 22. The front part of the tail plug 18 serves as a part closing the rear end of the front barrel 14. The rear end of the tail plug 18 that is greater in diameter than the front end thereof serves as a part closing the rear end of the rear barrel 22.

The hair applicator also has a cap 16 that covers the applying part 10 and the comb 12, as shown in FIG. 11. The cap 16 can be fitted to a thread 14*b* on the front barrel (forming a container with the tail plug 18) 14 by a thread (female thread) 16*b*. The cap 16 and the front barrel 14 are formed with projections 16*c* (see FIG. 14) and 14*f*, which ride over each other into a fitted state.

Detailedly, as shown in FIG. 13, the front barrel 14 has a pair of projections 14*f* that allow the projections 16*c* (not shown) to ride over. Each projection 14*f* protrudes radially outward adjacent to the front side of the flange 14*c*.

A rib 14*g* for stopping the rotation of the front barrel 14 relative to the rear barrel 22 is projectively formed on the rear side of the flange 14*c*. The projection 14*f* and the rib 14*g* are formed at the same position with respect to the circumferential direction of the front barrel 14. The rib 14*g* is formed as a projection on the inner surface of the front barrel so as to be engageable with a recess 22*d* to prevent the rear barrel 22 from rotating (see FIG. 12). The rib 14*g* and the recess 22*d* can be appropriately provided in any form as long as they are engaged with each other.

As shown in FIG. 13, the front barrel 14 has the comb 12 in the front end part 14*a*. A groove 14*h* for air replacement is formed on the inner side surface of a comb element 12*a* in contact with the applying part 10. As shown in FIG. 13, the groove 14*h* is formed in a portion facing one side surface of the applying part 10.

As shown in FIG. 14, the cap 16 has an inner cap 16*a* fitted and accommodated inside a main body forming an outer covering. In the front end of the cap, ribs 16*d* for receiving the application liquid are formed radially on the inner surface of the inner cap. There are two projections 16*c* in the cap 16 shown in FIG. 14 and two projections 14*f* in the front barrel 14 (see FIGS. 12 and 13). However, one or three or more projections 16*c* and 14*f* may be formed.

According to the third embodiment, the projections 16*c* and 14*f* are formed on the cap 16 and the front barrel 14, respectively. Therefore, when the cap 16 is screw-fitted to the front barrel 14, the projections 16*c* ride over the projections 14*f* to create a clicking sensation when riding over.

The user can make sure from the click feeling that the cap 16 and the front barrel 14 have been fitted when the cap 16 is closed. Also, once the projections 16*c* and 14*f* ride over, the projections again need to ride over each other when turning in the removal direction, so that unintentional removal can be prevented.

Since the air replacement groove 14*h* is provided on the inner surface of the comb 12, air-liquid replacement can be smoothly performed in the applying part 10 and others. Thus, the air displacement from the applying part can be ensured, so that it is possible to prevent a supply shortage at the time of application.

In addition, the tail plug 18 abuts the inner surface 22*c* (bottom surface) at the rear end of the rear barrel 22, to reliably prevent the tail plug 18 from falling off inside the rear barrel 22, thereby making it possible to prevent the absorbent fabric 20 from falling from the applying part 10.

INDUSTRIAL APPLICABILITY

The hair applicator of the present invention can be used not only for human hair but also for animals.

EXPLANATION OF SYMBOLS

10 applying part
12 comb
12*a* comb element
12*b* beam
12*b*1 hollow
14 front barrel
14*a* front end part
14*b* male thread
14*c* flange
14*d* rib
14*e* projected portion
14*f* projection
14*h* groove
16 cap
16*b* thread
16*c* projection
20 absorbent fabric
22 rear barrel

The invention claimed is:

1. A hair applicator comprising:

an applying part made of a porous material; and a comb having a plurality of comb elements provided with the applying part, to thereby apply a hair dye from a container through the applying part to the hair while combing hair with the comb, wherein:

a coating amount by the applying part is 0.090 g/m or greater (porosity is 80% or higher), and a hardness of the applying part, as determined in accordance with ISO7619A, is less than A70.

2. The hair applicator according to claim 1, wherein the comb elements hold the applying part on a front side thereof, and the comb elements are projected forward from the applying part.

3. The hair applicator according to claim 2, wherein a hollow is formed on a surface of the comb element.

4. The hair applicator according to claim 3, wherein the surface area of a front endface of the comb element is 0.3 to 1.0 $mm^2$.

5. The hair applicator according to claim 4, further comprising a cap that covers the applying part and the comb, wherein the cap can be fitted to the container by screw fitting, and the cap and the container are formed with projections that ride over each other into a fitted state.

6. The hair applicator according to claim 5, wherein a groove for air replacement is formed on an inner surface of the comb.

* * * * *